United States Patent [19]

Havey, III

[11] 4,063,337

[45] Dec. 20, 1977

[54] MULTI-ELEMENT CASKET

[76] Inventor: Ambrose S. Havey, III, 107 N. Broadway, Yonkers, N.Y. 10701

[21] Appl. No.: 718,114

[22] Filed: Aug. 27, 1976

[51] Int. Cl.[2] ..... A61G 17/00

[52] U.S. Cl. ..... 27/2; 27/35

[58] Field of Search ..... 27/2, 10, 35, 19, 27

[56] References Cited

U.S. PATENT DOCUMENTS

| | | | |
|---|---|---|---|
| 684,293 | 10/1901 | McGriff | 27/35 |
| 748,692 | 1/1904 | Booth | 27/2 |
| 1,618,522 | 2/1927 | Fauley | 27/35 |
| 2,056,404 | 10/1936 | Lawrence | 27/2 |
| 2,655,712 | 10/1953 | Glassner | 27/2 |
| 3,103,053 | 9/1963 | Hollis | 27/35 |
| 3,133,334 | 5/1964 | Johnsen | 27/27 |

FOREIGN PATENT DOCUMENTS

| | | | |
|---|---|---|---|
| 909,488 | 9/1972 | Canada | 27/2 |

*Primary Examiner*—John D. Yasko

*Attorney, Agent, or Firm*—Breed, Stairs & Handal

[57] ABSTRACT

A multi-element casket, particularly useful for services involving the cremation of the deceased is disclosed. The casket comprises a container bottom configured and dimensioned to contain suitable bedding and the deceased. The container bottom is supported by a platform which also supports a casket shell. The casket shell is placed over the container bottom and has sidewalls which are configured and dimensioned to extend around the container bottom and be supported by the platform, thus giving the appearance of a conventional casket. When the deceased is to be cremated, the shell is raised and the container bottom, containing the deceased and the bedding, is covered and sent to the crematory.

14 Claims, 8 Drawing Figures

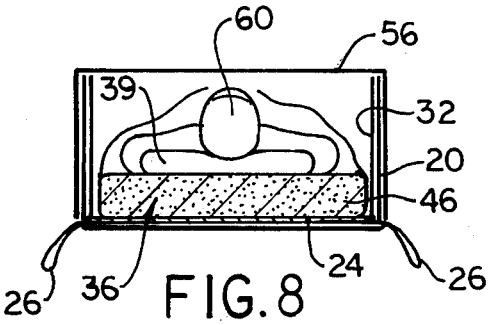
FIG. 8
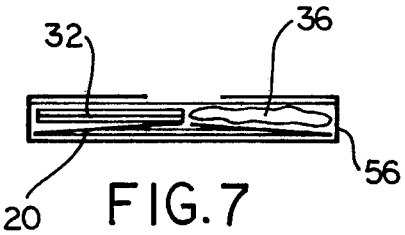
FIG. 7
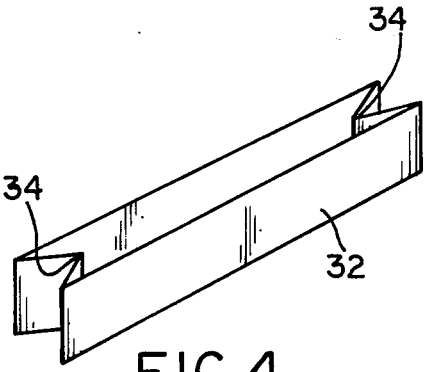
FIG. 4
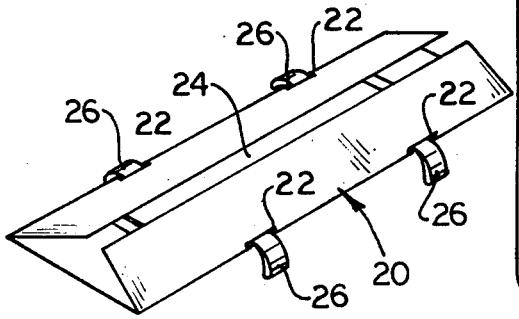
FIG. 3
FIG. 1
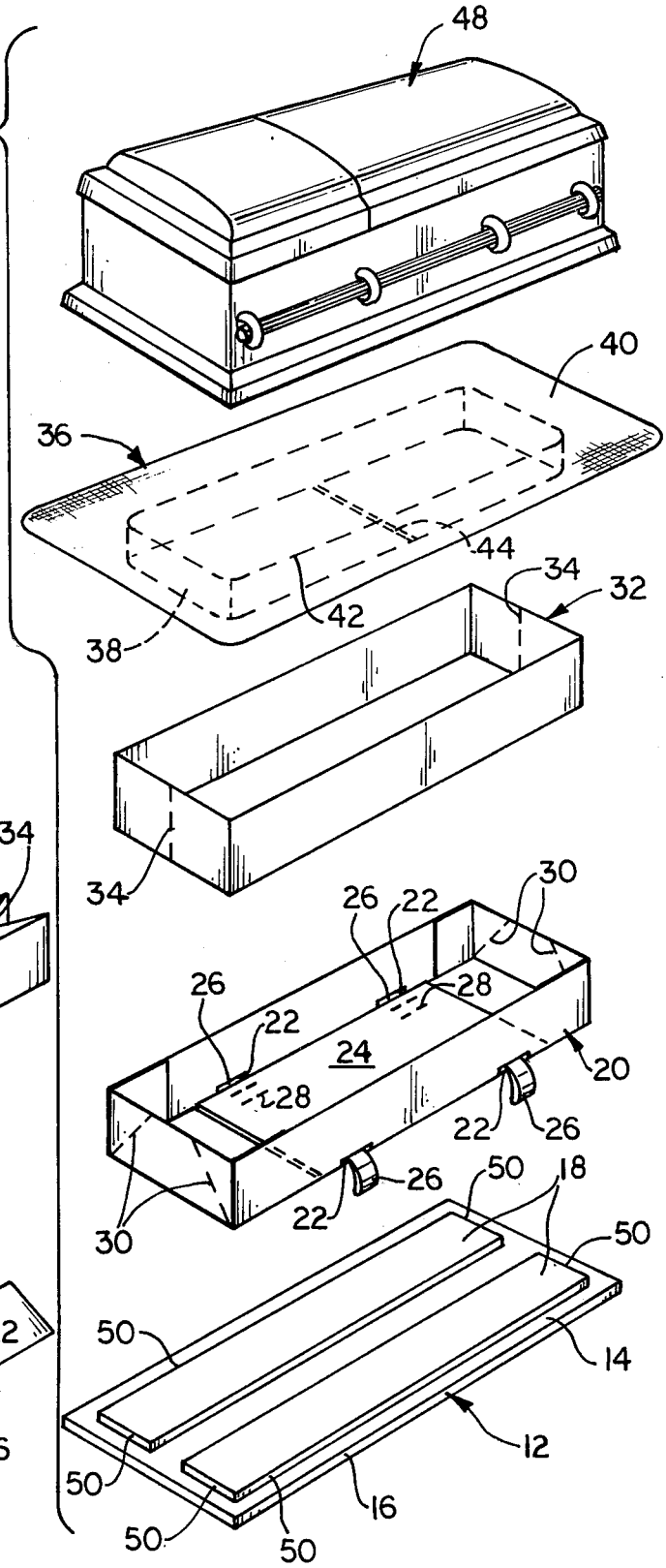

MULTI-ELEMENT CASKET

BACKGROUND OF THE INVENTION

Although modern technology has been applied in a great number of fields, the procedures and apparatus connected with funeral services have remained relatively unchanged since antiquity. Funerals have resisted the application of technology largely because of the solemnity and traditional conservativeness of the funeral ceremony. Thus, coffins, caskets, headstones and the like are prepared by means of conventional techniques and require the expenditure of extensive hand workmanship and traditional materials. This intransigence to change has thus rendered the funeral ceremony inordinately expensive in comparison to other things which have become more economical over the years through the efficiencies that accompany the application of technology.

The high cost associated with funerals, far from going unnoticed, has, in recent years become the object of rapidly mounting public concern. However, the funeral industry has, as yet, been unable to find an effective solution to this problem which maintains the dignity of the funeral service, satisfies basic health requirements, and so forth, while lowering the cost of the ceremony.

Among the attempts at reducing the high cost of funerals is U.S. Pat. No. 3,613,189 to Kirby. This patent discloses a casket comprising an outer shell having a substantially conventional appearance and a hinged end which swings open to allow the lengthwise insertion of an inner container. This arrangement suffers from a number of disadvantages. Primarily, lengthwise insertion is a difficult task due to the complications introduced by misalignment and friction. This problem is remedied to some extent by providing the casket with a series of rollers and a motor. However, this makes the casket relatively expensive and introduces a need for maintenance. The use of a hinged end also introduces an unfamiliar seam on the coffin, a seam which, with wear and bending, becomes increasingly obvious and unappealing. More importantly, however, the use of a motor and rollers is not in keeping with the dignity and conservativeness of the funeral ceremony. Moreover, in spite of these disadvantages, the savings are not very substantial because the inner container must be of a relatively high quality in order to have the structural strength to withstand the manipulation that goes along with use of the casket assembly.

Another approach to the end-loading two-piece casket is illustrated by U.S. Pat. No. 3,133,344 to Johnson. The device disclosed there is a bottomless casket shell which engages an inner container. The container is released through one end of the shell. This end of the shell has a sliding curtain which can be pulled open in much the same manner as the top of a roll-top desk. However, this structure also suffers from the disadvantage of being relatively expensive and not having the proper dignified appearance.

Still another casket incorporating an outer shell and an inner container is illustrated by U.S. Pat. No. 3,815,195 to Owens. In accordance with this patent the inner container adapted to receive and support four facade members, one of which incorporates a hinged lid. However, due to the important structural function of the inner container, it must be of reasonably high quality. The container must also incorporate specialized hardware which is provided for engaging the facade. The savings experienced with such an arrangement are thus not very substantial.

U.S. Pat. No. 3,654,676 to McHugh shows a two-piece casket in which the inner container includes a shoulder by which it is engaged by the outer shell. Here again the engagement structure requires a relatively expensive inner container. Moreover, the mechanics employed render the assembly somewhat inappropriate to a dignified funeral service.

In contrast to the prior art, the multi-element casket, contructed in accordance with the present invention appears even under close inspection to be a conventional casket. At the same time, the casket is relatively inexpensive and is of a construction that makes the incorporation of electrical motors, rollers, hinges and the like unnecessary. Still another advantage of the inventive casket is the fact that all the parts of the casket that come into contact with the deceased are disposed of and are most economically furnished for a single use at each service.

SUMMARY OF THE INVENTION

In accordance with the present invention, a multi-element casket, particularly useful for services involving cremation of the deceased is provided. The casket comprises a container bottom configured and dimensioned to contain a suitable bedding which is disposed within the container bottom. A platform is disposed below the container bottom to support it. The casket further comprises an outer casket shell having sidewalls and an openable top element, the outer casket shell being configured and dimensioned to extend around and be positioned over the container bottom and rest on the platform.

BRIEF DESCRIPTION OF THE DRAWINGS

FIG. 1 is an exploded perspective view of a multi-element casket constructed in accordance with the present invention;

FIG. 3 is a perspective view of the container bottom illustrating the manner in which it may be folded;

FIG. 4 is a perspective view of the vertical support member showing how it can be folded to facilitate shipment;

FIG. 7 is a cross-sectional view showing the various elements of the container as they are when folded and packed for shipment; and FIG. 8 is a cross-sectional view of the container prior to cremation.

DETAILED DESCRIPTION OF THE PREFERRED EMBODIMENT

Figure 2:
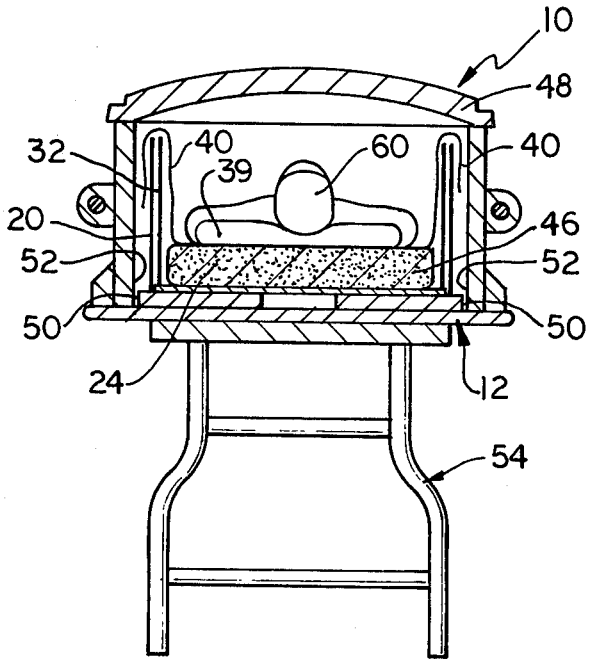
FIG. 2 is a cross-sectional view of the casket illustrated in FIG. 1 after assembly.

The various component elements of a multi-element casket 10 constructed in accordance with the present invention are illustrated in exploded perspective in FIG. 1. The base 12 of the casket is a rectangular planar element which may typically comprise a panel of plywood having a thickness of about ½ inch. Base 12 may be provided with a decorative molding 16, made of a hardwood or any other suitable material. A pair of planar members 18 are secured to base 12. These members perform the dual function of supporting the inner container and maintaining the casket shell in the proper position on the base.

Base 12 supports inner container bottom 20. Bottom 20 includes four elongated holes 22. Placed within bottom 20 is a planar bottom support member 24, which may be made of a rigid and relatively inexpensive material such as composition board. Four straps 26 are secured by staples 28 to the underside of bottom support member 24. When support member 24 is in the proper position, as illustrated in FIG. 1, straps 26 extend through holes 22 and thus facilitate the manual handling of the inner container when it contains the deceased. Bottom 20 is also provided with creases 30 which facilitate folding for shipment and also make possible storage in a minimum space. Bottom 20 may be made of corrugated cardboard or any other suitable material. In accordance with the preferred embodiment of the invention, double-corrugated cardboard, which has been water-proofed by waxing or other such process, is employed.

During use, container bottom 20 is maintained in the illustrated position by a support member 32 which rests inside the container bottom. Support 32 is provided with creases 34, which facilitate folding of the support member into a convenient form for transporation and storage.

Bedding 36 comprises a mattress 38, a pillow 39 and a liner 40. Liner 40 is secured to mattress 38 at the perimeter 42 of the mattress. Mattress 38 is also provided with a zipper 44. In accordance with the preferred embodiment of the invention, it is contemplated that the mattress will be shipped while empty, and stuffed with a filler 46 at the point of use. Stuffing is accomplished by opening zipper 44 and filling the mattress with any suitable material. When the filled mattress 38 is properly positioned within bottom 20, liner 40 is draped over support member 32 and the sidewalls of bottom 20 in the manner illustrated in FIG. 2. A casket shell 48 is then placed over the container, resting on base 12.

Planar members 18 are positioned on plywood board 14 in such a manner that their edges 50 are separated from each other by a distance which is slightly less than the distance between the lengthwise innerwalls 52 of casket shell 48. This assures that the casket is maintained in the proper position with respect to base 12. Two members are employed because this facilitates the proper placement of edges 50. Specifically, it is not necessary to cut a single planar member to the exact size. It is merely necessary to take two smaller members each of which is slightly narrower in width than half the width of a single member and place them with their edges 50 in a position that insures proper alignment of the edges with innerwalls 52 of casket shell 48.

Generally, the assembled multi-element casket 10 will rest on a table 54 during visiting hours at the home. The assembled inventive casket thus has the appearance of a conventional casket. Moreover, when it is reused those parts of the assembly which come into contact with the deceased are made of relatively inexpensive materials and may be cremated with the body.

Figure 5:
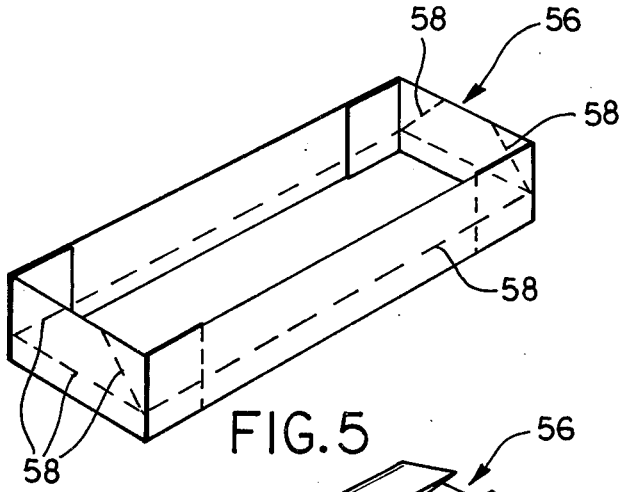
FIG. 5 is a perspective view of the container top.
Figure 6:
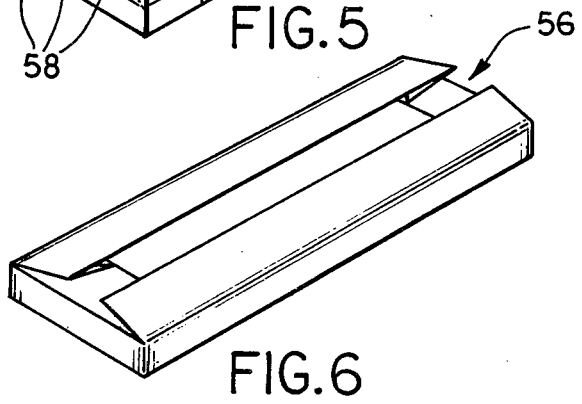
FIG. 6 is a perspective view of the container top illustrating the manner in which it may be folded.

In accordance with the present invention the disposable portion of the multi-element casket may be folded into a convenient package for storage and shipment. The manner in which container bottom 20 may be folded is illustrated in FIG. 3. It is folded along creases 30, allowing its sidewalls to be folded against its bottom. Referring to FIG. 4, support member 32 may also be folded into a more compressed form by folding along its creases 34. The container is also provided with a top 56 which is illustrated in FIG. 5. Top 56 includes creases 58, which allows it to be folded into the compressed form illustrated in FIG. 6.

In shipping the container, bottom 20, with bottom support member 24 in it, is folded, as illustrated in FIG. 3, and placed within top 56. Support member 32 is also folded as illustrated in FIG. 4 and also placed within top 56. An unfilled mattress 36 is placed within top 56 and top 56 is closed. The filled package, illustrated in cross section in FIG. 7, is thus a convenient package for storage and shipment.

Prior to the commencement of visiting hours, base 12 is placed on table 54. Container bottom 20 is then placed on base 12 with its sidewalls aligned with the edges 50 of planar members 18. Support member 32 is placed within bottom 20 and bedding 36 filled with an appropriate material is placed within bottom 20. Liner 40 is draped around support member 32 and the sidewalls of bottom 20 in the manner illustrated in FIG. 2. The deceased 60 is then placed within bottom 30 and casket shell 48 is positioned over the base. The assembled casket thus has the appearance of a conventional casket.

When the deceased is to be sent for cremation, casket shell 48 is lifted leaving the container bottom and its contents resting on table 54. The liner is folded into the container bottom and container top 56 is placed over the container to serve as a cover. The covered container, which is illustrated in cross-section FIG. 8, is then most easily moved to the point of cremation by a number of attendants who carry the container by gripping straps 26.

While a preferred embodiment of the invention has been illustrated, it is, of course, understood that various modifications may be made in the size and configuration of the elements of the inventive multi-element casket without departing from the spirit and scope of the invention which is defined and limited only by the appended claims. For example, the size of support member 24 may be extented to support the head of the deceased, or the number and position of straps 26 may be varied. Moreover, the term casket embraces both four-sided caskets, coffins and the equivalent.

What is claimed is:

1. A multi-element casket, comprising:

a. bedding;

b. a foldable container bottom configured and dimensioned to contain said bedding, said container bottom having sidewalls and a bottom element;

c. a platform disposed below said container bottom, said platform being separate from said container bottom; and d. and outer casket shell having an openable top element and sidewalls, said outer casket shell being configured and dimensioned to extend around and be positioned over said container bottom and rest on said platform.

2. A multi-element casket as in claim 1, further comprising alignment means secured to said platform, said alignment means including edges positioned to engage the inner walls of said sidewalls when said outer casket shell is placed over said platform.

3. A multi-element casket as in claim 2 wherein said alignment means comprises a pair of planar members.

4. A multi-element casket as in claim 1, wherein said bedding comprises a mattress having top and bottom planar surfaces and a liner secured to said mattress, said liner being positioned, configured and dimensioned to be draped around the top of said container sidewalls.

5. A multi-element casket as in claim 4 wherein the bottom planar surface of said mattress is provided with zipper means which allows the pad to be opened for the convenient insertion of filler.

6. A multi-element casket as in claim 4 wherein the bottom of said container bottom is reinforced by a rigid planar member disposed in said container bottom and further includes a plurality of straps secured to it and extending out from holes in said container bottom.

7. A multi-element casket as in claim 1 further comprising a foldable support member for maintaining said container bottom in an unfolded position.

8. A multi-element casket as in claim 7 further comprising a cover adapted to be folded into a box adapted to contain the folded container bottom, and folded foldable support member and unfilled bedding.

9. A multi-element casket as in claim 1 wherein the bottom of said container bottom is reinforced by a rigid planar member.

10. A multi-element casket as in claim 9 wherein said rigid planar member is disposed in said container bottom and further includes a plurality of straps secured to it and extending out from holes in said container bottom.

11. A method of cremation, comprising the steps of:

a. placing a foldable container bottom on a platform; which is separate from said container bottom;
b. placing a suitable bedding in the container bottom;
c. arranging the bedding in the container bottom;
d. placing the deceased in the container bottom over the bedding;
e. placing a casket shell having an openable top over the container bottom containing the deceased and the bedding;
f. allowing said casket shell to remain in position for a period of time to allow visitation of the deceased;
g. removing said casket shell;
h. covering said container bottom; and
i. sending said container bottom to the crematory.

12. A multi-element casket, comprising:

a. bedding, comprising a mattress having top and bottom planar surfaces and a liner secured to said mattress, said mattress being adapted to be filled with a filler material;
b. a container bottom configured and dimensioned to contain said bedding and adapted to be folded to take up a smaller volume;
c. a platform disposed below said container bottom, said platform being separate from said container bottom;
d. an outer casket shell having an openable top element and sidewalls, said outer casket shell being configured and dimensioned to extend around and be positioned over said container bottom and rest on said platform;
e. a foldable support member for maintaining said container bottom in an unfolded position; and
f. a cover adapted to be folded into a box adapted to contain the folded container bottom, the folded foldable support member, and unfilled bedding.

13. A multi-element casket, comprising:

a. bedding;
b. container bottom configured and dimensioned to contain siad bedding, said container bottom being reenforced by a rigid planar member disposed in said container bottom and further including a plurality of straps secured to it and extending out from holes in said container bottom, said container bottom being adapted to be folded to takeup a smaller volume;
c. a platform disposed below said container bottom, said platform being separate from said container bottom;
d. an outer casket shell having an openable top element and sidewalls, said outer casket shell being configured and dimensioned to extend around and be positioned over said container bottom and rest on said platform;
e. foldable support member for maintaining said container bottom in an unfolded position;
f. a cover adapted to be folded into a box adapted to contain the folded container bottom and a folded foldable support member and unfilled bedding.

14. A multi-element casket as in claim 13, further comprising alignment means secured to said platform, said alignment means including edges positioned to engage the inner walls of said sidewalls when said outer casket shell is placed over said platform.

* * * * *